US010774573B2

(12) United States Patent
Webb et al.

(10) Patent No.: US 10,774,573 B2
(45) Date of Patent: Sep. 15, 2020

(54) WINDOW CONTROL SYSTEM

(71) Applicant: DENSO International America, Inc., Southfield, MI (US)

(72) Inventors: Gareth Webb, New Hudson, MI (US); Dustin Garrett, Coleman, MI (US)

(73) Assignee: DENSO International America, Inc., Southfield, MI (US)

( * ) Notice: Subject to any disclaimer, the term of this patent is extended or adjusted under 35 U.S.C. 154(b) by 192 days.

(21) Appl. No.: 16/051,587

(22) Filed: Aug. 1, 2018

(65) Prior Publication Data

US 2020/0040637 A1 Feb. 6, 2020

(51) Int. Cl.
*E05F 15/695* (2015.01)
*E05F 15/79* (2015.01)

(52) U.S. Cl.
CPC ..... *E05F 15/695* (2015.01); *E05F 15/79* (2015.01); *E05Y 2400/324* (2013.01); *E05Y 2400/356* (2013.01); *E05Y 2400/65* (2013.01)

(58) Field of Classification Search
CPC .. E05F 15/695; E05F 15/79; E05Y 2400/324; E05Y 2400/356; E05Y 2400/65
USPC ..... 307/139
See application file for complete search history.

(56) References Cited

U.S. PATENT DOCUMENTS

| | | | | |
|---|---|---|---|---|
| 5,760,554 | A * | 6/1998 | Bustamante | H03K 17/96 318/280 |
| 5,901,500 | A | 5/1999 | Tsuda et al. | |
| 5,925,997 | A | 7/1999 | Yamaoka | |
| 6,366,040 | B1 | 4/2002 | McLennan et al. | |
| 6,541,929 | B2 | 4/2003 | Cregeur | |
| 6,657,140 | B2 | 12/2003 | Rantet | |
| 7,187,146 | B2 | 3/2007 | Saito et al. | |
| 7,268,506 | B2 | 9/2007 | Nakagawa et al. | |
| 7,362,068 | B2 | 4/2008 | Yamamoto | |
| 7,411,364 | B2 | 8/2008 | Takahashi | |
| 7,770,327 | B2 | 8/2010 | Noro et al. | |
| 8,827,027 | B2 | 9/2014 | Syvret et al. | |
| 9,255,435 | B2 | 2/2016 | Weidenbacher | |
| 9,394,739 | B2 | 7/2016 | Ogawa et al. | |
| 9,500,020 | B2 | 11/2016 | Imai et al. | |
| 2004/0201276 | A1 | 10/2004 | Torrents Gavalda et al. | |
| 2016/0222712 | A1 | 8/2016 | Nishio et al. | |
| 2016/0305176 | A1 | 10/2016 | Ko et al. | |

* cited by examiner

*Primary Examiner* — Hal Kaplan
(74) *Attorney, Agent, or Firm* — Harness, Dickey & Pierce, P.L.C.

(57) ABSTRACT

A window control system includes a switch and a motor controller. The switch is manipulated by an operator and transmits signals based on the manipulation. The motor controller receives signals from the switch, determines a preset position from the signals, and commands a motor to move a window to the preset position. The preset position is one of at least three preset positions either programmed by a manufacturer or customized by the operator.

12 Claims, 3 Drawing Sheets

WINDOW CONTROL SYSTEM

FIELD

The present disclosure relates to window control systems, and, more specifically, to a sequential or custom window control system.

BACKGROUND

This section provides background information related to the present disclosure which is not necessarily prior art.

Power windows often include an automatic, or "auto," function which allows the window to fully close or open in the vehicle. The driver activates the auto function by pressing the window control switch once to open or close the window. Despite the ease or convenience of the auto function, the auto function is rigid in the "open" and "closed" functions, not allowing the window to be opened or closed in a fraction of the full open or full closed position.

SUMMARY

This section provides a general summary of the disclosure, and is not a comprehensive disclosure of its full scope or all of its features.

An example method of a window control system according to the present disclosure includes a switch and a motor controller. The switch is manipulated by an operator and transmits signals based on the manipulation. The motor controller receives signals from the switch, determines a preset position from the signals, and commands a motor to move a window to the preset position. The preset position is one of at least three preset positions either programmed by a manufacturer or customized by the operator.

The motor controller may further include a detection circuit in communication with the switch and receiving signals from the switch. The detection circuit may analyze the signals to determine the preset position.

The motor controller may further include a motor command circuit in communication with the detection circuit and receiving signals from the detection circuit. The motor command circuit may transmit a direction and length of travel command to the motor based on the signals from the detection circuit.

The motor may energize at least one actuator to move the window in the commanded direction for the commanded length of travel.

The preset position may be one of a full-open preset position, a full-closed preset position, halfway-open preset position, and quarter-open preset position.

A number of clicks of the switch may indicate the preset position.

A depression depth of the switch may indicate the preset position.

A time-length of the manipulation of the switch may indicate the preset position.

An example method for controlling a window according to the present disclosure includes: transmitting, by a switch, signals indicating a manipulation of the switch by an operator; determining, by a motor controller, a preset position from the signals; and commanding, by the motor controller, a motor to move a window to the preset position, wherein the preset position is one of at least three preset positions either programmed by a manufacturer or customized by the operator.

The method may further include analyzing, by a detection circuit, the signals from the switch to determine the preset position.

The method may further include transmitting, by a motor command circuit, a direction and length of travel command to the motor 30 based on the signals from the detection circuit.

The method may further include energizing, by the motor, at least one actuator to move the window in the commanded direction for the commanded length of travel.

The preset position may be one of a full-open preset position, a full-closed preset position, halfway-open preset position, and quarter-open preset position.

A number of clicks of the switch may indicate the preset position.

A depression depth of the switch may indicate the preset position.

A time-length of the manipulation of the switch may indicate the preset position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
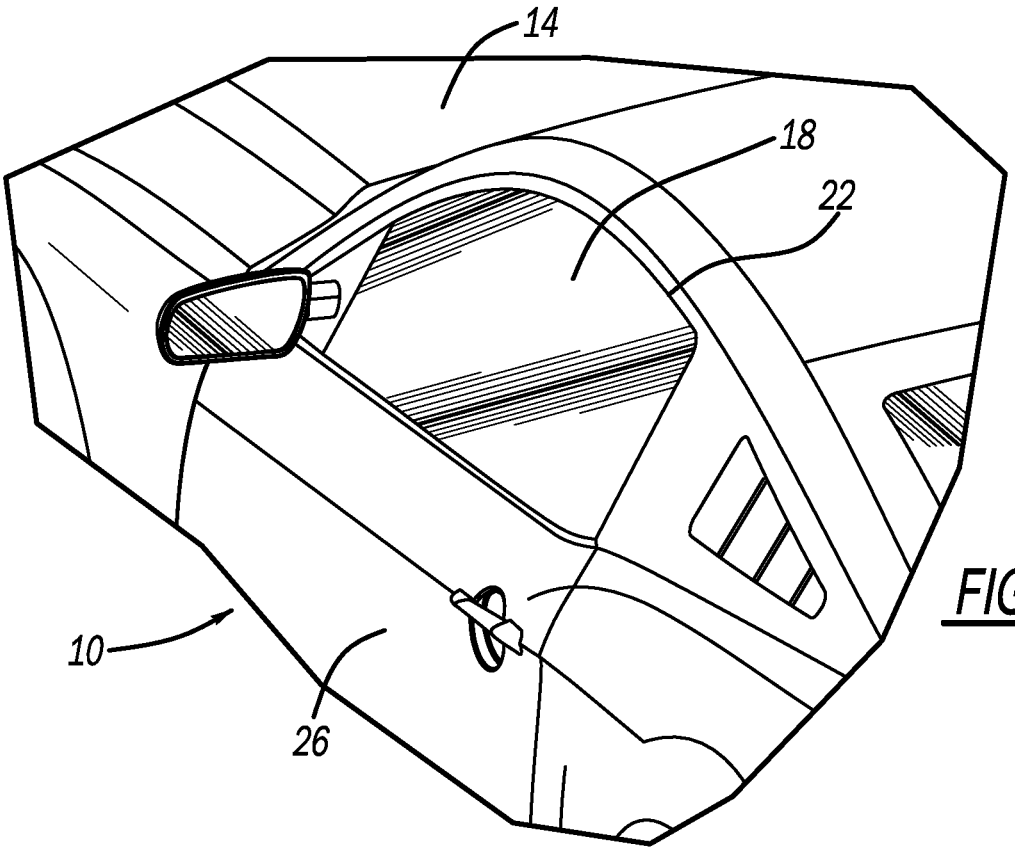
FIGS. 1A-1D illustrate various positions of a window of a vehicle according to the present disclosure.

Example embodiments will now be described more fully with reference to the accompanying drawings.

The present disclosure describes sequential controller for a vehicle door window that allows a driver to have preset positions for the window. In a case where the driver desires to have the window only an inch down, halfway open, a fraction open, or fully closed, the sequential window controller accommodates the driver's needs. For example, in vehicles having sunroofs, removable roofs, convertibles, or standard vehicles, ideal window heights exist which can decrease a buffeting sound in the vehicle that occurs when one or more windows are open. When the driver requires extra air flow in the vehicle, having an ideal preset for the window position to prevent buffeting sound in the car can decrease distraction and also generate ideal air flow through the vehicle.

The window control system of the present disclosure has a plurality, for example three or four, preset positions for the auto function. The preset positions may be, for example, ¼ open, ½ open, full open, and full closed. For example only, ¼ open may be attained by one light press, or one click, halfway, or ½ open, may be attained by a harder press, or two clicks, and fully open may be attained by a hard press, or three clicks. The reverse may close the window. The "presets" for the window may come straight from the factory and/or may be customized by the driver within an infotainment display or another method.

Now referring to FIGS. 1A-1D, a window system 10 for a vehicle 14 according to the present disclosure is illustrated. The vehicle 14 may be any vehicle having windows, a sunroof, a convertible top, etc. The vehicle 14 may be any suitable passenger vehicle, utility vehicle, commercial vehicle, recreational vehicle, mass transit vehicle, military vehicle/equipment, construction vehicle/equipment, etc.

One example of the window system 10 may include a window 18 disposed within a frame 22 in a door 26. The window 18 may be any window for a vehicle 14 including a window disposed in a door, a sunroof, a convertible top, etc. An embodiment of the window disposed in a door is representative of these types of windows and is described herein. However, this disclosure may be applied to any window movable within a frame.

Figure 2:
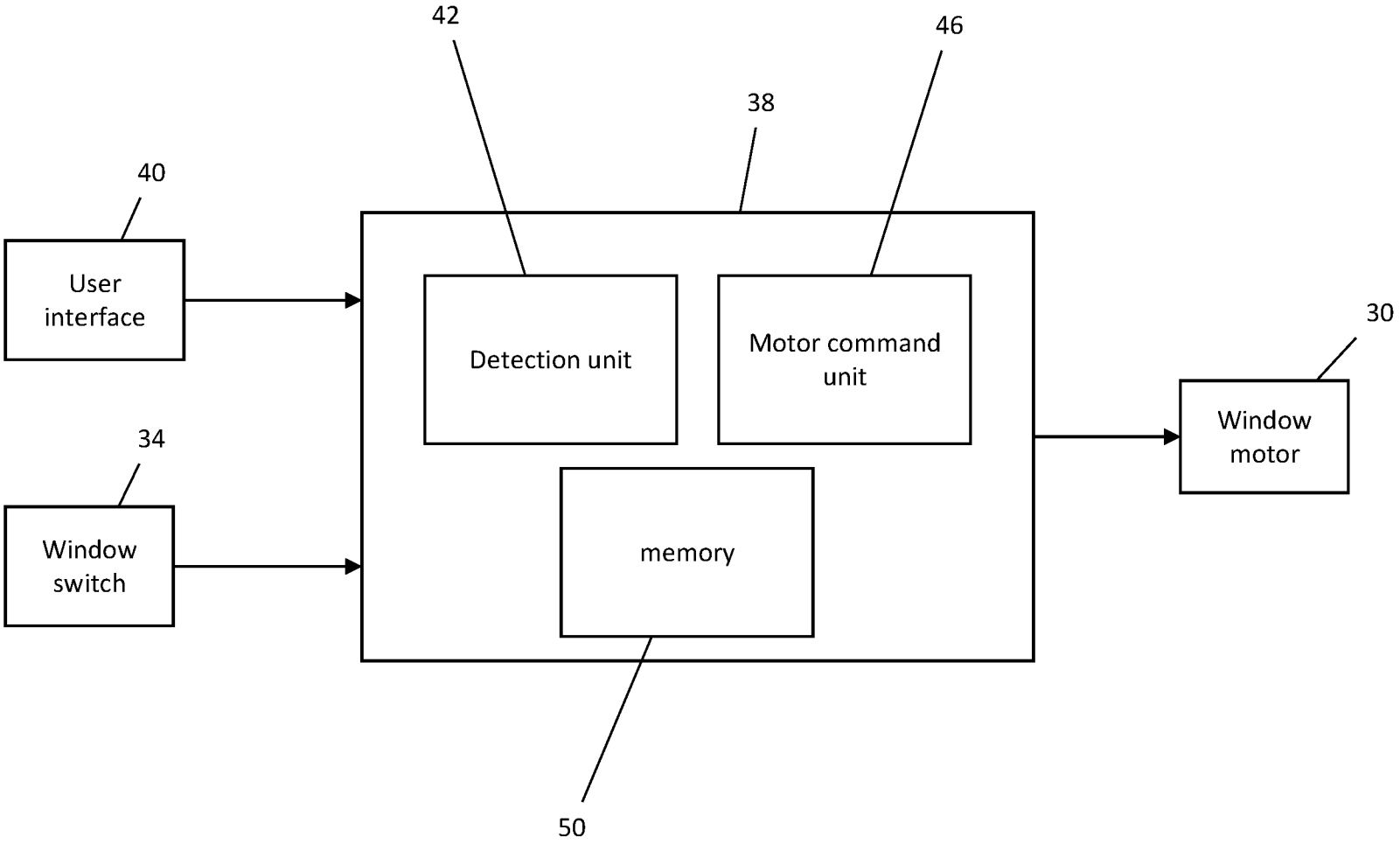
FIG. 2 is a schematic view of a window control system according to the present disclosure.

The window 18 is configured to slideably move relative to the frame 22 and may be physically supported by window tracks 28 disposed in the frame 22. The window, or mechanisms controlling the window, may be electrically connected to a motor 30 (FIG. 2). The motor 30, as further described below, may control the movement (for example only, up and down movement) of the window 18 within the frame 22.

A switch 34 may provide a user interface for controlling the position of the window 18 relative to the frame 22. The switch 34 may be electrically connected to a controller 38 (FIG. 2) which, in turn, is connected to the motor 30. As described below, the controller 38 may detect and interpret signals from the switch 34 and command the motor 30 to open or close the window 18. The signals received by the controller 38 may indicate one of a plurality (for example, at least three, and, more specifically, four or more) preset positions for the window 18.

In some embodiments, actuators or other mechanisms may physically control the position of the window 18 relative to the frame 22. The actuators or other mechanisms are controlled by the motor 30. While these embodiments are one example of controlling the position of the window, it is understood that any mechanism physically controlling the position of the window may be implemented for this disclosure.

Further, the controller 38 and motor 30 may be disposed within an interior of the door 26 at a position near the mechanisms physically controlling the position of the window 18, but the present disclosure is not limited to these locations. It is understood that any location of the controller 38 and motor 30 may be applied to the present disclosure.

With additional reference to FIG. 2, the controller 38 may be a sequential controller or customizable controller that allows a driver to have preset positions for the window. The driver may set various switch functions to one or more presets, such that when the driver performs the switch function, the controller 38 and motor 30 automatically move the window 18 to the preset position. The presets may be set by the manufacturer and/or may be customizable by the driver. The driver may set the presets using a user interface 40, such as an infotainment system or other user interface, for example.

Figure 1B:
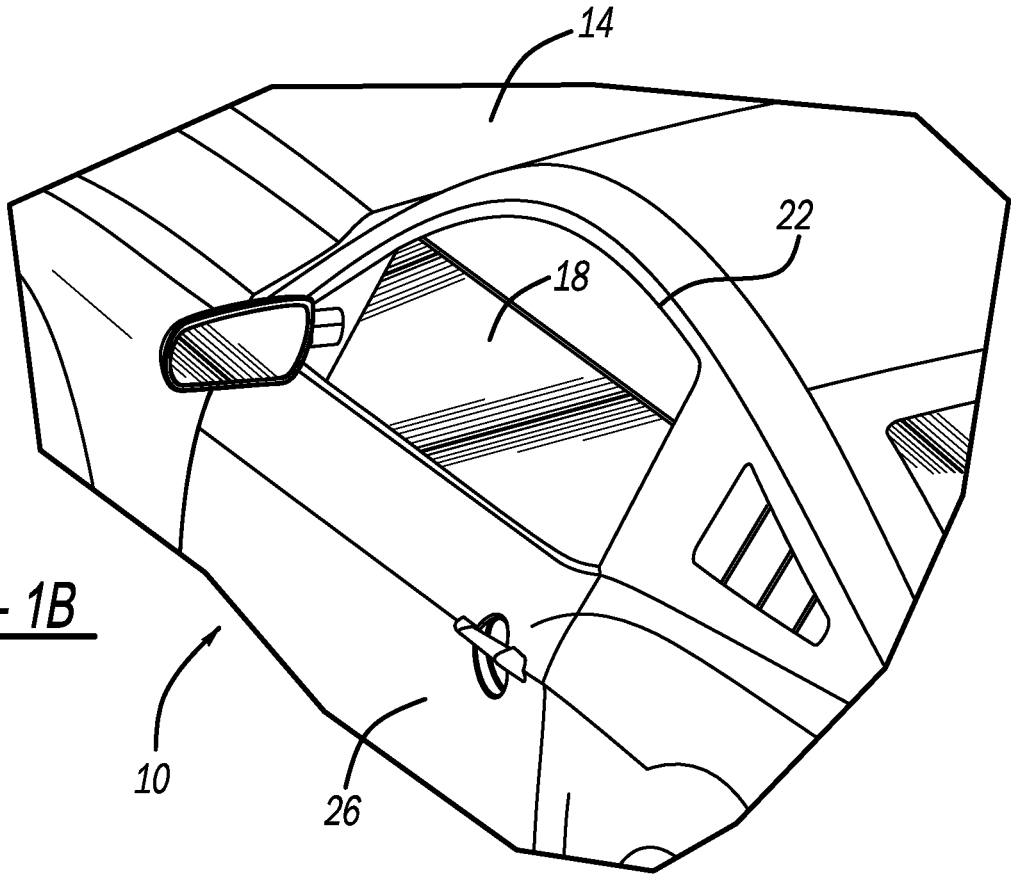
Figure 1C:
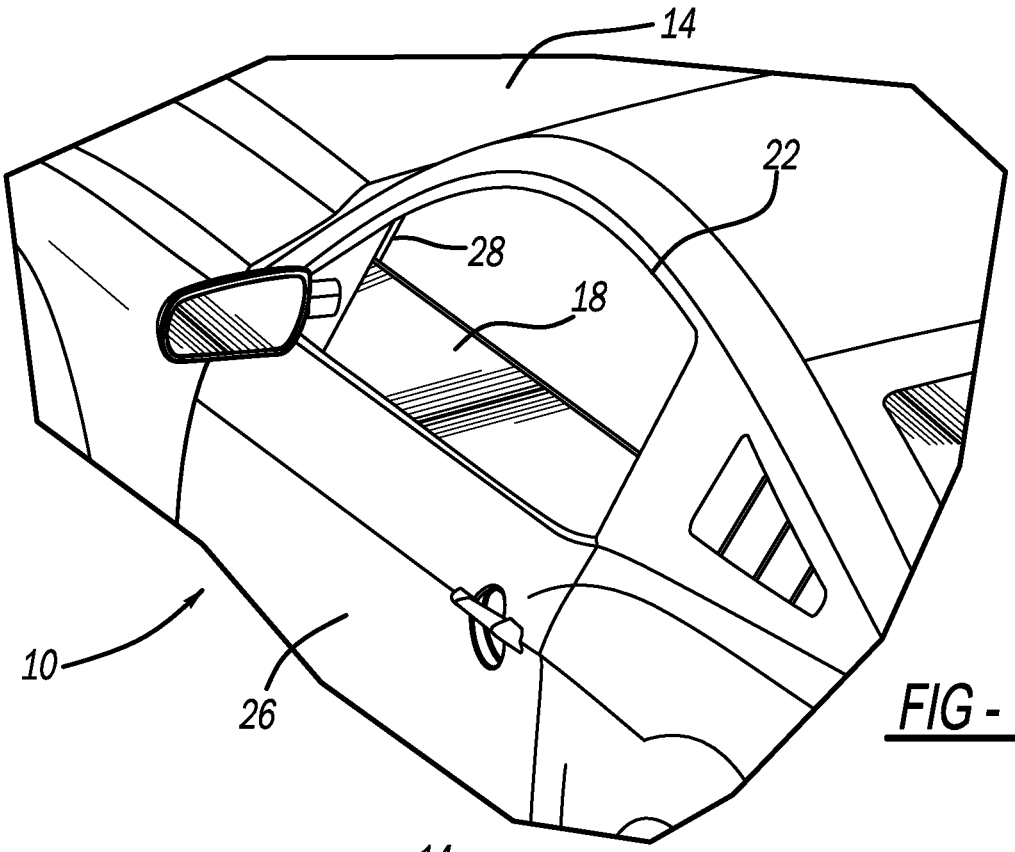
Figure 1D:
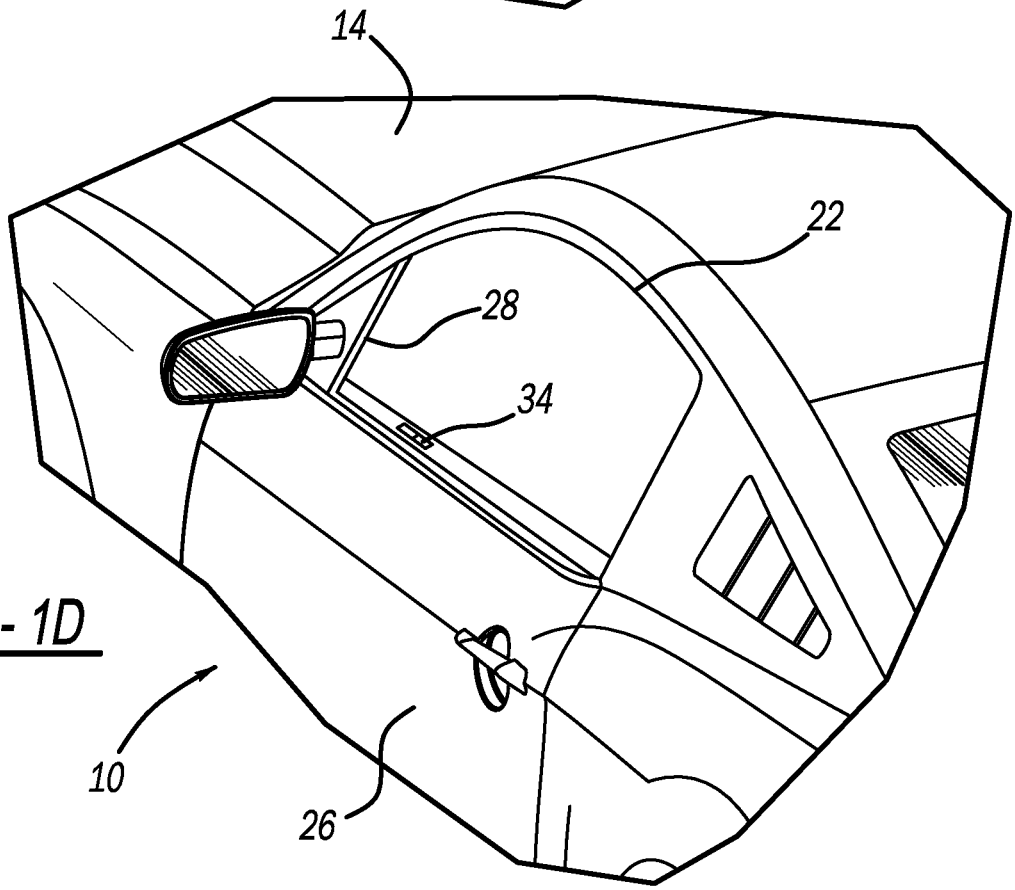

FIGS. 1A-1D provide example preset window positions. FIG. 1A illustrates the window 18 in a fully closed position. FIG. 1B illustrates the window 18 in a ¼ (quarter) open position. FIG. 1C illustrates the window 18 in a ½ (halfway) open position. FIG. 1D illustrates the window 18 in a fully open position. For example, as previously stated, quarter open (FIG. 1B) may be attained by one light press, or one click, of the switch 34 downward, halfway open (FIG. 1C) may be attained by a harder press, or two clicks, of the switch 34 downward, and fully open (FIG. 1D) may be attained by a hard press, or three clicks of the switch 34 downward. One light press, or one click, of the switch 34 upward may move the window 18 one quarter (¼) closed, one harder press, or two clicks, of the switch 34 upward may move the window 18 halfway (½) closed (FIG. 1C), and one hard press, or three clicks of the switch 34 upward may move the window 18 fully closed (FIG. 1A).

Returning to FIG. 2, the controller 38 may include a detection module or unit 42, a motor command module or unit 46, and a memory 50. In this application, the term "module" or "unit" may be replaced with the term "circuit." The term "module" may refer to, be part of, or include processor hardware (shared, dedicated, or group) that executes code and memory hardware (shared, dedicated, or group) that stores code executed by the processor hardware. The code is configured to provide the features of the modules described herein. The term memory hardware is a subset of the term computer-readable medium. The term computer-readable medium, as used herein, does not encompass transitory electrical or electromagnetic signals propagating through a medium (such as on a carrier wave). The term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The detection unit 42 communicates with the window switch 34 and detects signals from the window switch 34 when the window switch 34 is operated by a driver or other user. As previously explained, the controller 38 may be a sequential controller or customizable controller 38 that allows a driver to have preset positions for the window. The driver may set various switch functions to one or more presets, such that when the driver performs the switch function, the controller 38 and motor 30 automatically move the window 18 to the preset position. The presets may be set by the manufacturer and/or may be customizable by the driver or user through a driver interface 40, such as an infotainment system, for example.

The detection unit 42 may continuously monitor the window switch 34 for signals. The types of signals sent from the window switch 34 to the detection unit 42 may include depth of depression of the window switch, indicating a light press, a harder press, or a hard press, and/or time-length of depression of the window switch. Upon receiving signals from the window switch 34, the detection unit 42 may determine which of a plurality of preset options is commanded by the driver.

The plurality of preset options may be stored in the memory 50. In the case where the driver or user customizes (or reprograms) the preset position, the memory 50 may receive the programmed positions from the user interface 40 and may overwrite the previous preset position with the user's programmed position. The memory 50 may further store trigger settings and motor 30 commands for each preset option. The detection unit 42 and motor command unit 46 may be in communication with the memory 50 to access the information related to the plurality of preset options.

In some embodiments, a light press of the switch 34 downward, may indicate the quarter-open preset, a harder press of the switch 34 downward may indicate the halfway-open preset, a hard press of the switch 34 downward may indicate the fully-open preset, a light press of the switch 34 upward may indicate quarter closed, a harder press of the switch 34 upward may indicate halfway closed, and a hard press of the switch 34 upward may indicate fully closed. For example, a light press may be quantified as depressing/pulling the switch 34 up to ¼ of the maximum movement of the switch 34. A harder press may be quantified as depressing/pulling the switch 34 within a range of ¼ to ¾ the maximum movement of the switch 34. A hard press may be quantified as depressing/pulling the switch 34 greater than ¾ the maximum movement of the switch 34.

In other embodiments, one activation, or click, of the switch 34 downward, may indicate the quarter-open preset, two activations, or clicks, of the switch 34 downward may indicate the halfway-open preset, three activations, or clicks, of the switch 34 downward may indicate the fully-open preset, one activation, or click, of the switch 34 upward may indicate quarter closed, two activations, or clicks, of the switch 34 upward may indicate halfway closed, and three activations, or clicks, of the switch 34 upward may indicate fully closed. For example, each activation, or click, can be for any amount of time and the activations, or clicks, are separated by a release of the switch 34.

In still other embodiments, a short press of the switch 34 downward, may indicate the quarter-open preset, a longer press of the switch 34 downward may indicate the halfway-open preset, a long press of the switch 34 downward may indicate the fully-open preset, a short press of the switch 34 upward may indicate quarter closed, a longer press of the switch 34 upward may indicate halfway closed, and a long press of the switch 34 upward may indicate fully closed. For example, a short press may be quantified as depressing/pulling the switch 34 up to 0.5 seconds (s). A longer press may be quantified as depressing/pulling the switch 34 within a range of 0.5 s to 1 s. A hard press may be quantified as depressing/pulling the switch 34 greater than 1 s.

In still other embodiments, the switch 34 may include individual buttons or other activators that may be programmed to each preset and pressed to activate the specific, desired preset. For example, the switch may include at least three, and, more specifically, four buttons, indicating quarter-open, halfway-open, full open, and full closed. The driver or user may depress the button to indicate the specific setting to the detection unit 42.

While some examples are provided herein, it is understood that many different methods of conveying a preset position may be implemented and are envisioned herein.

The detection unit 42 communicates with the motor command module or unit 46. The motor command unit 46 receives the preset position from the detection unit 42. Using the preset position, the motor command unit 46 determines a direction and length of travel command to the motor 30 based on the received preset position. For example, the motor command unit 46 may communicate with the memory 50 to gather preset position information and determine length of travel for the preset position.

For example, for a quarter-open preset position, the motor command unit 46 may communicate a window-down direction and 5 inches of travel (for a 20-inch window). For a halfway-open preset position, the motor command unit 46 may communicate a window-down direction and 10 inches of travel (for a 20-inch window). For a full-open preset position, the motor command unit 46 may communicate a window-down direction and 20 inches of travel (for a 20-inch window). For a quarter-closed preset position, the motor command unit 46 may communicate a window-up direction and 5 inches of travel (for a 20-inch window). For a halfway-closed preset position, the motor command unit 46 may communicate a window-up direction and 10 inches of travel (for a 20-inch window). For a full-closed preset position, the motor command unit 46 may communicate a window-up direction and 20 inches of travel (for a 20-inch window).

In some embodiments, the motor command unit 46 may determine a current position of the window based on previous commands to the motor 30. Although this is not necessary for the function of the window system 10, the motor command unit 46 may use the current window position and the received preset position to calculate a desired window position. The motor command unit 46 may then send commands to the motor 30 based on the desired window position (instead of the preset position).

Upon receiving the commands from the motor command unit 46, the motor 30 energizes the actuators (or other mechanisms) to move the window 18 in the commanded direction for the commanded length of travel.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module," the term "unit," or the term "controller" may be replaced with the term "circuit." The term "module" or the term "unit" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module or unit may include one or more interface circuits. In some examples, the interface circuits may include wired or wireless interfaces that are connected to a local area network (LAN), the Internet, a wide area network (WAN), or combinations thereof. The functionality of any given module or unit of the present disclosure may be distributed among multiple modules or units that are connected via interface circuits. For example, multiple modules or units may allow load balancing. In a further example, a server (also known as remote, or cloud) module or unit may accomplish some functionality on behalf of a client module or unit.

The term code, as used above, may include software, firmware, and/or microcode, and may refer to programs, routines, functions, classes, data structures, and/or objects. The term shared processor circuit encompasses a single processor circuit that executes some or all code from multiple modules or units. The term group processor circuit encompasses a processor circuit that, in combination with additional processor circuits, executes some or all code from one or more modules or units. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules or units. The term group memory circuit encompasses a memory circuit that, in combination with additional memories, stores some or all code from one or more modules or units.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A window control system comprising:

a switch manipulated by an operator and transmitting signals based on the manipulation; and a motor controller receiving signals from the switch, determining a preset position from the signals, and commanding a motor to move a window to the preset position, the motor controller including a detection circuit in communication with the switch and receiving signals from the switch, the detection circuit analyzing the signals to determine the preset position, and a motor command circuit in communication with the detection circuit and receiving signals from the detection circuit, the motor command circuit transmitting a direction and length of travel command to the motor based on the signals from the detection circuit, wherein the preset position is one of at least three preset positions either programmed by a manufacturer or customized by the operator.

2. The window control system of claim 1, wherein the motor energizes at least one actuator to move the window in the commanded direction for the commanded length of travel.

3. The window control system of claim 1, wherein the preset position is one of a full-open preset position, a full-closed preset position, halfway-open preset position, and quarter-open preset position.

4. The window control system of claim 1, wherein a number of clicks of the switch indicates the preset position.

5. The window control system of claim 1, wherein a depression depth of the switch indicates the preset position.

6. The window control system of claim 1, wherein a time-length of the manipulation of the switch indicates the preset position.

7. A method for controlling a window comprising:

transmitting, by a switch, signals indicating a manipulation of the switch by an operator;

determining, by a motor controller, a preset position from the signals;

analyzing, by a detection circuit, the signals from the switch to determine the preset position;

transmitting, by a motor command circuit, a direction and length of travel command to the motor based on the signals from the detection circuit; and commanding, by the motor controller, a motor to move a window to the preset position, wherein the preset position is one of at least three preset positions either programmed by a manufacturer or customized by the operator.

8. The method of claim 7, further comprising:

energizing, by the motor, at least one actuator to move the window in the commanded direction for the commanded length of travel.

9. The method of claim 7, wherein the preset position is one of a full-open preset position, a full-closed preset position, halfway-open preset position, and quarter-open preset position.

10. The method of claim 7, wherein a number of clicks of the switch indicates the preset position.

11. The method of claim 7, wherein a depression depth of the switch indicates the preset position.

12. The method of claim 7, wherein a time-length of the manipulation of the switch indicates the preset position.

* * * * *